US010851314B2

(12) United States Patent
Hodgkins et al.

(10) Patent No.: US 10,851,314 B2
(45) Date of Patent: Dec. 1, 2020

(54) METHOD TO IMPROVE THE EFFICIENCY OF PIPELINE TRANSPORTATION OF HEAVY OILS

(71) Applicant: Saudi Arabian Oil Company, Dhahran (SA)

(72) Inventors: Robert Peter Hodgkins, Dhahran (SA); Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/386,821

(22) Filed: Apr. 17, 2019

(65) Prior Publication Data

US 2020/0332202 A1 Oct. 22, 2020

(51) Int. Cl.
*C10G 29/28* (2006.01)
*F17D 1/17* (2006.01)

(52) U.S. Cl.
CPC ..... *C10G 29/28* (2013.01); *F17D 1/17* (2013.01); *C10G 2300/1044* (2013.01); *C10G 2300/302* (2013.01); *C10G 2300/802* (2013.01)

(58) Field of Classification Search
CPC ..... C10G 29/28; C10G 2300/302; C10G 2300/802; C10G 2300/1044; F17D 1/17
See application file for complete search history.

(56) References Cited

U.S. PATENT DOCUMENTS 4,379,490 A 4/1983 Sharp
4,476,929 A 10/1984 Stapp
10,240,096 B1 * 3/2019 Koseoglu ..... B01D 11/043
2011/0259791 A1 10/2011 Mesters
2013/0172638 A1 * 7/2013 Borremans ..... B01J 27/043 585/250
2014/0000886 A1 1/2014 Milam et al.

FOREIGN PATENT DOCUMENTS

CN 102116144 A 7/2011
CN 105505445 B 7/2017
WO 2016087895 A1 6/2016

OTHER PUBLICATIONS

Petroleum HPV Testing Group (2010) U.S. EPA HPV Challenge Program Data Review and Assessment for Reclaimed Substances: Disulfides, Diethyl and Diphenyl, Naphtha Sweetening , American Petroleum Institute, Washington, D.C., 107 pgs.*
International Search Report and Written Opinion dated May 27, 2020 in counterpart International Application PCT/US2020/019183.
Mansourpoor, M., "Experimental Investigation of Rheological Behavior and Wax Deposition of Waxy Oil-Disulfide Oil Systems", Feb. 11, 2019, Natural Resources Research, vol. 28, No. 4, pp. 1609-1617.

* cited by examiner

*Primary Examiner* — Brian A McCaig
(74) *Attorney, Agent, or Firm* — Abelman, Frayne & Schwab

(57) ABSTRACT

Disulfide oil (DSO) compounds recovered as a by-product of the mercaptan oxidation of a hydrocarbon refinery feedstock and their oxidized derivatives, oxidized disulfide oils (ODSO) are effective as a diluent to lower the viscosity and thereby improve the pipeline transportation properties of heavy oils, and particularly of wellhead crude oil. The use of the DSO and/or ODSO compounds as diluents converts an otherwise extremely low value or waste oil product into a valuable commodity that has utility in improving the transportation properties of heavy oils, particularly in oil field pipeline applications.

20 Claims, 3 Drawing Sheets

METHOD TO IMPROVE THE EFFICIENCY OF PIPELINE TRANSPORTATION OF HEAVY OILS

BACKGROUND OF THE INVENTION

Field of the Invention

This disclosure relates to the pipeline transportation of heavy oils, and specifically to improvements in the efficiency of the transportation by lowering the viscosity of the heavy oils.

Description of Related Art

Transportation of Oil by Pipelines

Oil transportation via pipelines is becoming an increasingly complex and technical process, especially in light of the efforts in the field to transport highly viscous heavy crude oils from the wellhead. Heavy crudes are generally highly viscous and at room temperature can have solid-like properties. This means that they cannot easily be pumped through the pipelines as is necessary for transporting the oil from the wellhead to a refinery, or to preliminary processing station such as gas/oil separation plant (GOSP). Since a significant fraction of the global oil reserves include heavy crude oils, technologies to improve the efficiency of pipeline transportation are of special interest to both oil field producers and refineries as a means of reducing related energy costs.

The viscosity of heavy oil can exceed values of 100,000 mPa·s, while preferred viscosities for efficiently transporting fluids in pipelines are generally less than 380 mPa·s. A summary comparing the characteristics of various crude of oils is provided in Table 1 which was derived from an article entitled *Required Viscosity Values To Ensure Proper Transportation of Crude Oil by Pipeline* by José A. D. Muñoz, Jorge Ancheyta and Luis C Castañeda, that appeared in *Energy Fuels* 2016, 30, 8850-8854, which is incorporated herein in its entirety by reference.

TABLE 1

| Crude oil | Origin | Type | API Gravity ° | Viscosity @25° C. cSt | Viscosity @50° C. cSt |
|---|---|---|---|---|---|
| Duri | Indonesia | heavy | 20.8 | 779 | 175 |
| Maya | Mexico | heavy | 21.2 | 240 | 66 |
| Cold Lake | Canada | heavy | 21.2 | 133 | 40.1 |
| Zuata | Venezuela | extra-heavy | 14.8 | 4,349 | 305 |
| Boscan | Venezuela | extra-heavy | 8.9 | 69,543 | 4,190 |

From the data shown in Table 1, it is clear that viscosities can vary significantly depending upon the source of the crude oil and are not directly dependent on the API gravity of the oil. The Table 1 data also illustrates the relationship between viscosity and temperature. As is known to those skilled in the art, wellhead crude oil temperatures can vary widely, e.g., as between subsea and land-based production facilities, and light oils have been introduced into the well annulus in order to reduce the viscosity of the mixture in the production tubing.

The same Muñoz reference classifies the crude oils as a function of viscosities at 25° C. into the following four categories:

Class A are medium heavy crude oils with a viscosity in the range of from 10 to 100 cP, which is equivalent to 10 to 100 mPa·s, which is also equivalent to ~11 to 111 cSt;

Class B are extra-heavy crude oils with a viscosity in the range of from 100 to 10,000 cP, which is equivalent to 100 to 10,000 mPa·s, which is also equivalent to ~11 to 10,150 cSt;

Class C are bitumens with a viscosity greater than 10,000 cP, which is equivalent to 10,000 mPa·s, which is also equivalent to ~10,150 cSt. Class C oils generally have an API gravity less than 7°, which means that they are immovable at reservoir conditions and consequently require thermal recovery methods such as steam injection or use of mining techniques for their recovery; and Class D are bituminous shales and are considered as a source rock that can be extracted using mining or in situ techniques.

As light and medium oil reserves are depleted around the world, the exploitation of heavy crudes oils that are found in abundance is becoming a more favored source of refinery feed stocks. Various technologies are known for reducing heavy oil viscosities. These technologies are typically classified into the following categories: (a) viscosity reduction, which includes techniques such as dilution/blending, heating, emulsification and pour point reduction; (b) friction reduction, which includes steps such as additives that reduce drag; and (c) upgrading, which includes methods used to produce a synthetic crude with lower viscosity.

Common diluents used to reduce viscosities include natural gas condensates, naphtha, kerosene and lighter crudes. Additionally, alcohols and ethers, i.e., polar solvents, can also be used and may actually improve octane numbers in downstream products. Diluent quantities typically required for the treatment of heavy crude oils are up to 20 W %, whereas the treatment of heavier classes of oils, such as bitumen, require diluents in the range of from 25 to 50 W %.

Viscosities of heavy crude oils can also be reduced by orders of magnitude by heating the oil and/or pipelines to thereby improve the efficient flow of the oil. However, the heating or preheating of the oil and/or the pipeline incurs considerable capital and operating costs associated with the infrastructure and energy consumption, and also comes with the risk of potential pipeline corrosion and associated environmental issues.

Surfactants can be used to emulsify and stabilize the oil in water in order to reduce the viscosity of oils. In this method, the surfactant resides at the oil-water interface and hinders droplet growth and phase separation. Crude oils naturally contain components such as asphaltenes, porphyrins, resins and naphthenic acids that can act as emulsifiers. However, if the emulsification is used to reduce the viscosity of the oil for transportation, it will then be necessary to break the oil-water emulsion, at a gas/oil separation plant (GOSP). Thermal-, electro-, and chemical-demulsification techniques coupled with solvent addition or a pH change can be used to break the emulsion. The rheology of the emulsion strongly depends on the droplet size and distribution, which is linked to the surfactant choice and process conditions. Crude oils are typically stabilized when the droplet size is 10 μm or less. Disadvantages of this method include the costs associated with the surfactant, the degree of the surfactant's ability to maintain the emulsion during transportation, and the need to remove the surfactant from the emulsion at the refinery.

Crude oils comprise liquid phase maltenes, i.e., saturates, aromatics, resins, and solute asphaltenes. The precipitation and aggregation of asphaltenes in the colloidal suspension contributes to the high density and viscosity. The pour point is the lowest temperature at which the oil ceases to flow and where crystals may form. Polymeric inhibitors, e.g., polyacrylates and polymethacrylate, can be used to minimize crystal formation/deposition and to improve crude oil flow properties.

The wall friction and viscous drag in a pipeline during the transportation of the oil is significantly more pronounced when transporting heavy crude oils as compared to transporting lighter oils. Viscous drag is a result of fluid shear-stresses at the wall and causes fluid pressure within the pipeline to decrease. Drag reduction can be achieved by lubricating the interior walls of the pipelines.

Upgrading an oil typically involves thermally cracking and catalytically processing it to produce a synthetic oil that has reduced viscosity and improved flow properties. For example, the visbreaking technology has been widely accepted and units have been installed around the world to lower the viscosity of heavy oils. Upgrading heavy oils at the wellhead is not always economically feasible, and the availability of diluents is a logistic issue that refiners must address when making plans for pipeline transportation to downstream processing facilities.

The problem exists of providing an efficient and economical method to lower the viscosity, and thereby improve the transportation properties of heavy oils.

The Mercaptan Oxidation (MEROX) Process

The mercaptan oxidation process, commonly referred to as the MEROX process, has long been employed for the removal of the generally foul smelling mercaptans found in many hydrocarbon streams and was introduced in the refining industry over fifty years ago. Because of regulatory requirements for the reduction of the sulfur content of fuels for environmental reasons, refineries have been, and continue to be faced with the disposal of large volumes of sulfur-containing by-products of the mercaptan oxidation process.

Disulfide oil (DSO) compounds are produced as a by-product of the MEROX process in which the mercaptans are removed from any of a variety of petroleum streams including liquefied petroleum gas, naphtha, and other hydrocarbon fractions. It is commonly referred to as a 'sweetening process' because it removes the sour or foul smelling mercaptans present in crude petroleum. The term "DSO" is used for convenience in this description and in the claims, and will be understood to include the mixture of disulfide oils produced as by-products of the mercaptan oxidation process.

As noted above, the designation "MEROX" originates from the function of the process itself, i.e., the conversion of mercaptans by oxidation. The MEROX process in all of its applications is based on the ability of an organometallic catalyst in a basic environment, such as a caustic, to accelerate the oxidation of mercaptans to disulfides at near ambient temperatures and pressures. The overall reaction can be expressed as follows:

$$RSH+\tfrac{1}{4}O_2 \rightarrow \tfrac{1}{2}RSSR+\tfrac{1}{2}H_2O \quad (1)$$

where R is a hydrocarbon chain that may be straight, branched, or cyclic, and the chains can be saturated or unsaturated. In most petroleum fractions, there will be a mixture of mercaptans so that the R can have 1, 2, 3 and up to 10 or more carbon atoms in the chain. This variable chain length is indicated by R and R' in the reaction. The reaction is then written:

$$2R'SH+2RSH+O_2 \rightarrow 2R'SSR+2H_2O \quad (2)$$

This reaction occurs spontaneously whenever any sour mercaptan-bearing distillate is exposed to atmospheric oxygen, but proceeds at a very slow rate. In addition, the catalyzed reaction (1) set forth above requires the presence of an alkali caustic solution, such as aqueous sodium hydroxide. The mercaptan oxidation proceeds at an economically practical rate at moderate refinery downstream temperatures.

The MEROX process can be conducted on both liquid streams and on combined gaseous and liquid streams. In the case of liquid streams, the mercaptans are converted directly to disulfides which remain in the product so that there is no reduction in total sulfur content of the effluent stream.

The MEROX process typically utilizes a fixed bed reactor system for liquid streams and is normally employed with charge stocks having end points above 135° C.-150° C. Mercaptans are converted to disulfides in the fixed bed reactor system over a catalyst, for example, an activated charcoal impregnated with the MEROX reagent, and wetted with caustic solution. Air is injected into the hydrocarbon feedstream ahead of the reactor and in passing through the catalyst-impregnated bed, the mercaptans in the feed are oxidized to disulfides. The disulfides are substantially insoluble in the caustic and remain in the hydrocarbon phase. Post treatment is required to remove undesirable by-products resulting from known side reactions such as the neutralization of $H_2S$, the oxidation of phenolic compounds, entrained caustic, and others.

The vapor pressures of the disulfides are relatively low compared to those of mercaptans, so that their presence is much less objectionable from the standpoint of odor; however, they are not environmentally acceptable due to their sulfur content and their disposal can be problematical.

In the case of mixed gas and liquid streams, extraction is applied to both phases of the hydrocarbon streams. The degree of completeness of the mercaptan extraction depends upon the solubility of the mercaptans in the alkaline solution, which is a function of the molecular weight of the individual mercaptans, the extent of the branching of the mercaptan molecules, the concentration of the caustic soda and the temperature of the system. Thereafter, the resulting DSO compounds are separated and the caustic solution is regenerated by oxidation with air in the presence of the catalyst and reused.

Referring to the attached drawings, FIG. 1 is a simplified schematic of a generalized conventional version of a MEROX process of the prior art employing liquid-liquid extraction for removing sulfur compounds in an embodiment in which a combined propane and butane hydrocarbon stream (1) containing mercaptans is treated and which includes the steps of:

introducing the hydrocarbon stream (1) with a homogeneous cobalt-based catalyst into an extraction vessel (10) containing a caustic solution (2);

passing the combined hydrocarbon and catalyst stream in counter-current flow through the extraction section of the extraction (10) vessel in which the extraction section includes one or more liquid-liquid contacting extraction decks or trays (not shown) for the catalyzed reaction with the circulating caustic solution to convert the mercaptans to water soluble alkali metal alkane thiolate compounds;

withdrawing a hydrocarbon product stream (3) that is free or substantially free of mercaptans from the extraction vessel (10);

recovering a combined spent caustic and alkali metal alkane thiolate stream (4) from the extraction vessel (10);

subjecting the spent caustic to catalyzed wet air oxidation in a reactor (20) into which is introduced catalyst (5) and air (6) to regenerate the spent caustic (8) and to convert the alkali metal alkane thiolate compounds to disulfide oils; and recovering a by-product stream (7) of disulfide oil (DSO) compounds and a minor proportion of sulfides.

The effluents of the wet air oxidation step in the MEROX process preferably comprise a minor proportion of sulfides and a major proportion of disulfide oils which can also include mono-sulfides and trisulfides. As is known to those skilled in the art, the composition of this effluent stream depends on the effectiveness of the MEROX process, and sulfides are assumed to be carried-over material. A variety of catalysts have been developed for the commercial practice of the process. The efficiency of the MEROX process is also a function of the amount of dissolved $H_2S$ present in the feedstream being treated. It is a common refinery practice to install a prewashing step for removal of dissolved $H_2S$.

The disulfide oil compounds produced in the MEROX process can contain various disulfides. For example, a MEROX unit designed for the recovery of propane and butane yields a disulfide oil mixture with the composition set forth in Table 2:

TABLE 2

| Disulfide Oil | W% | BP, ° C. | MW g/g.mol | Sulfur, W% |
|---|---|---|---|---|
| Dimethyldisulfide | 15.7 | 110 | 94 | 68.1 |
| Diethyldisulfide | 33.4 | 152 | 122 | 52.5 |
| Methylethyldisulfide | 49.3 | 121 | 108 | 59.3 |
| Total (average) | 98.4 | (127.7) | (109) | (57.5) |

Table 2 indicates the composition of the disulfide oil that is derived from semi-quantitative GC-MS data. The components were not measured against standards; however, the data in Table 2 is accurate as representing relative quantities. Quantitative total sulfur content was determined by energy dispersive x-ray fluorescence spectroscopy which indicated 63 wt % of sulfur, and this value was used in later calculations. The GC-MS results provide evidence of trace quantities of tri-sulfide species; however, the majority of the disulfide oil stream comprises the three components identified in Table 2.

The by-product disulfide oils produced by the MEROX unit can be processed and/or disposed of in various other refinery operations. For example, the DSO can be added to the fuel oil pool at the expense of a resulting higher sulfur content of the pool. The DSO can be processed in a hydrotreating/hydrocracking unit at the expense of higher hydrogen consumption. The disulfide oil also has an unpleasant foul or sour smell, which is somewhat less prevalent because of its relatively lower vapor pressure at ambient temperature; however, problems exist in the handling of this oil.

By-product disulfide oil (DSO) compounds from the mercaptan oxidation process can be oxidized, preferably in the presence of a catalyst, and constitute an abundant source of the ODSO compounds that are sulfoxides, sulfonates, sulfinates and sulfones. The oxidant can be a liquid peroxide selected from the group consisting of alkyl hydroperoxides, aryl hydroperoxides, dialkyl peroxides, diaryl peroxides, peresters and hydrogen peroxide. The oxidant can also be a gas, including air, oxygen, ozone and oxides of nitrogen. The catalyst is preferably a homogeneous water-soluble compound that is a transition metal containing an active species selected from the group consisting of Mo (VI), W (VI), V (V), Ti (IV), and their combination.

The ODSO compounds have been found to have utility as lubricity additives for diesel fuels that are more economical than currently available additives for that purpose, and also as solvents for aromatic solvent extraction processes. In the event that a refiner has produced or has on hand an amount of ODSO compounds that is in excess of foreseeable needs for these or other uses, the refiner may wish to dispose of the ODSO compounds in order to clear a storage vessel and/or eliminate the product from inventory for tax reasons.

Thus, there is a clear and long-standing need to identify new uses for the relatively large volumes of DSO refinery by-products of the mercaptan oxidation process that can be utilized to economic advantage in connection with refinery operations and elsewhere, and to enhance the value of this class of by-products to the refinery operator.

SUMMARY OF THE INVENTION

The above needs are met and other advantages are provided by the process of the present invention that advantageously utilizes disulfide oils, and their derivatives, oxidized disulfide oils, both of which are of relatively low value, to lower the viscosity and thereby improve the pipeline transportation properties of heavy oils. The disulfide oils and oxidized disulfide oils having utility as viscosity modifiers for heavy crude oil and other viscous hydrocarbons in the present process and systems are by-products derived from the mercaptan oxidation process of refinery feedstocks.

In an embodiment, the present disclosure is directed to an integrated refinery process for the utilization of DSO compounds resulting from the removal of mercaptans from a hydrocarbon stream containing the mercaptans in the modification of the properties, including the viscosity and density, of a heavy oil prior to, and/or during its transportation in an oil pipeline. The integrated process comprises:

introducing the hydrocarbon stream containing mercaptans into an extraction vessel containing an alkaline solution;

passing the hydrocarbon stream through an extraction section of the extraction vessel which includes one or more liquid-liquid contacting decks for reaction to convert the mercaptans to water soluble compounds;

withdrawing a hydrocarbon product stream free of mercaptans from the extraction vessel;

recovering a spent caustic solution containing sulfur compounds from the extraction vessel;

subjecting the spent caustic sulfur-containing solution to air oxidation to produce waste water and a by-product stream containing disulfide oils and sulfides;

separating the disulfide oils and sulfides from the waste water;

recovering the disulfide oil (DSO) and determining its viscosity under standard test conditions; and mixing a predetermined amount of the disulfide oil (DSO) stream with a stream of heavy oil having a known viscosity to produce a heavy oil-DSO blend, wherein the heavy oil-DSO blend has a lower density and a lower viscosity than the heavy oil stream under the prevailing conditions.

Suitable test methods for determining the viscosity of the DSO stream include ASTM D445, ASTM D466 and ASTM D7042.

It will be understood that since the source of the DSO is a refinery feedstream, the "R" and "R'" hydrocarbon substituents in the formula R'SSR can vary, e.g., methyl, ethyl, and other subgroups that can contain up to 10 carbon atoms, and the number of sulfur atoms, S, in the as-received DSO feedstream can be up to 3, i.e., trisulfide compounds. Similar conditions are present in embodiments that utilize the oxidized derivates of the DSO by-product, i.e., embodiments that use an ODSO stream, or a mixed stream of DSO/ODSO compounds.

The process and apparatus of the present disclosure enables refiners and gas plant operators to utilize a relatively low value by-product that some refiners may consider to be a waste disulfide oil stream to beneficially lower the viscosity and density of a heavy oil to facilitate the transportation of the heavy oil via pipeline, or to reduce the viscosity to facilitate processing within the battery limits of the refinery.

The use of diluents as viscosity modifiers for hydrocarbons are known in the art. Preliminary steps include the determination of at least the viscosity of both the heavy oil and the diluent DSO and ODSO compounds under the predetermined conditions prevailing in the pipeline, including particularly temperature, and pressure.

It will be understood that the amount, i.e., the volume or weight % of the diluent DSO compounds is predetermined to achieve the desired reduction in the viscosity of the heavy-oil-diluent blend in order to achieve the desired degree of improvement in the efficiency of the pipeline transportation under the conditions prevailing in a given section of pipeline. As will also be understood by one of skill in the art, the heavy oil moving in the pipeline can be expected to undergo changes of temperature and pressure as it moves through what can be hundreds of miles of pipeline from the wellhead to its initial processing location. Climate changes, e.g., extremes of heat and cold between day and night in high desert locations, as well as broader seasonal swings during summer and winter will affect the temperature and pressure of the heavy oil moving through the pipeline.

In the description that follows, the terms "disulfide oil", "disulfide oils", "DSO", "DSO mixture" and "DSO compounds" may be used interchangeably for convenience and will be understood to include reference to multiple compounds in proportions that vary with the nature and source of the feed from which they were derived during the mercaptan oxidation of the feed.

In the description that follows, the terms "oxidized disulfide oil", "oxidized disulfide oils", "derivative(s) of disulfide oil", "ODSO", "ODSO mixture" and "ODSO compound(s)" may be used interchangeably for convenience, and will also comprehend the presence of a variety of products.

In the description that follows, the terms "DSO/ODSO", "DSO/ODSO mixture(s)" and "DSO/ODSO compound(s)" may be used interchangeably for convenience.

In the description that follows, the diluent may be referred as "DSO" for convenience, and it will be understood that the term "diluent" includes ODSO alone or in combination with DSO.

BRIEF DESCRIPTION OF THE DRAWINGS

The process of the disclosure will be described in more detail below and with reference to the attached drawings in which the same number is used for the same or similar elements, and where.

DETAILED DESCRIPTION OF PREFERRED EMBODIMENTS

Figure 1:
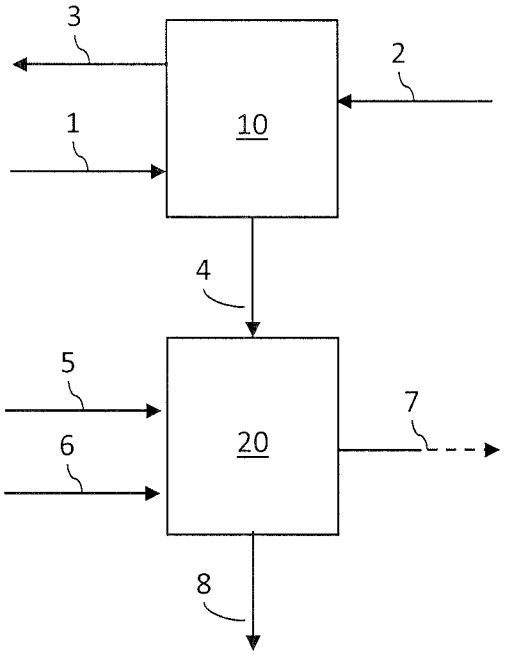
PRIOR ART FIG. 1
FIG. 1 is a simplified schematic diagram of a generalized version of the mercaptan oxidation or MEROX process of the prior art for the liquid-liquid extraction of a combined propane and butane stream.
Figure 2:
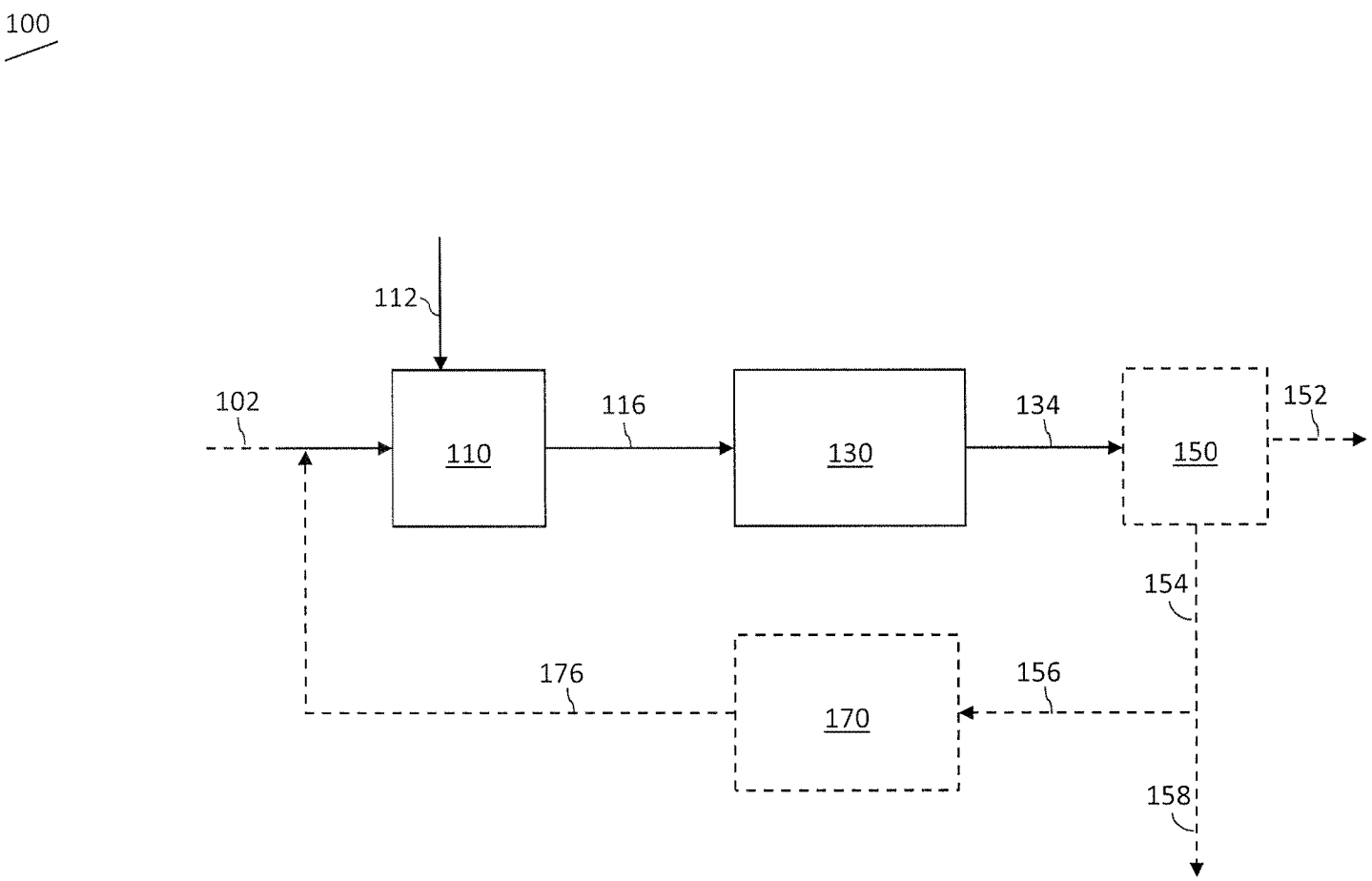
FIG. 2 is a simplified schematic diagram of an embodiment of the process of the present disclosure.

Referring now to FIG. 2, the process and system of the present disclosure includes a mixing zone (110), and a first transportation zone (130), and optionally a fractionation zone (150) and second transportation zone (170). A DSO stream recovered as a by-product of the mercaptan oxidation of a hydrocarbon refinery feedstock and/or an ODSO stream, or mixed DSO/ODSO compounds are used as a diluent stream. A fresh diluent stream (102) and a heavy oil stream (112) are introduced into the mixing zone (110) at a first location for mixing to produce a heavy oil-diluent blend (116). The heavy oil-diluent blend (116) is introduced into the first transportation zone (130) for transport to a second location, e.g., a GOSP or a refinery. The heavy oil-diluent blend (134) that arrives at the second location is unaltered with respect to the heavy oil-diluent blend (116) that passed from the mixing zone. It will be understood that the terms "transportation zone" comprehends a conventional oil pipeline and/or a pipeline system. Included are collection pipelines extending from multiple wellheads in an oil field to one or more local/regional storage tanks, as well as long-distance pipelines from wellheads to processing facilities.

The heavy oil-diluent blend (134) can optionally be sent to a fractionating zone (150) for separation into a heavy oil stream (152) and a recovered diluent stream (154). Diluent stream (154) can either be discharged for disposal as stream (158) or preferably is recovered as DSO recycle stream (156) and passed to a second transportation zone (170) for its return to the first location as DSO recycle stream (176) at the first location where it is mixed with the fresh diluent stream (102) upstream of the mixing zone (110). In certain embodiments, up to 90 W %, or 95 W %, or even 99 W % of the DSO introduced as the fresh diluent stream (102) is recovered as DSO recovered recycle stream (176) In a further embodiment (not shown), DSO recycle stream (156) is passed to another location for further use.

The heavy oil stream (152) can be processed routinely in downstream refinery operations.

In certain embodiments, the second transportation zone (170) is eliminated. In this embodiment, a separate pipeline is used within the first transportation zone (130) to transport the DSO recycle stream (156) so that it is not commingled with the heavy oil-diluent blend.

In embodiments where the heavy oil-diluent blend (134) is not processed to recover the DSO in a fractionation zone (150), the blend is routinely processed in downstream refinery operations (not shown) at the second location.

Fractionating zone (150) can include a flash drum, a distillation column, a stripper operated with steam, or nitrogen, or a combination thereof, or other fractionation means known in the art.

Examples of suitable feeds constituting the heavy oil stream (112) include crude oil produced at a wellhead, bitumens, heavy crude oil, coal liquids, atmospheric residue, vacuum residue, pitch from solvent deasphalting, and heavy oil derived from refinery processes such as distillation, solvent deasphalting, delayed coking, FCC processing. Suitable feeds include crudes in the categories of Class A, Class B and Class C, as defined above.

In certain embodiments, the heavy oil has an API gravity of less than 30°, less than 20°, or less than 10°. In certain embodiments, the heavy oil has a viscosity greater than about 1,000 mPa·s, and in preferred embodiments, greater than about 380 mPa·s.

The DSO, ODSO, or mixed DSO/ODSO diluent stream is mixed with the heavy oil in a predetermined amount in the range of from 1 W % to 99 W %, and a preferred range of from 5 W % to 50 W %. The diluent stream is compatible with asphaltenes and therefore no sediment formation occurs after mixing with the heavy oil.

In certain embodiments, the heavy oil-diluent blend has a viscosity less than about 400 mPa·s, less than about 380 mPa·s, or less than about 200 mPa·s, as suggested by Hart, A. J Petrol Explor Prod Technol (2014) 4: 327, which is incorporated herein in its entirety by reference.

In certain embodiments, the heavy oil-diluent blend is transported in a pipeline at a temperature in the range of from 20° C. to 80° C., or in the range from 20° C. to 80° C. and at a pressure in the range of from 1 bar to 5 bars.

The refinery operations downstream include, but are not limited to, gas/oil separation plants, processes such as distillation, naphtha hydrotreating, kerosene hydrotreating, diesel hydrotreating, and hydrocracking operations.

In certain embodiments, the diluent stream is comprised of one or more disulfide oil compounds having the general formula R'SSR, where R and R' are straight, branched or cyclic hydrocarbons having 1, 2, 3 and up to 10 carbon atoms that are saturated or unsaturated, and where R and R' can be the same or different.

In other embodiments, the diluent stream is comprised of one or more oxidized disulfide oil compounds having the general formula $O_x$R'SSR, where x is an integer in the range of from 1 to 4, R and R' are straight, branched or cyclic hydrocarbons having 1, 2, 3 and up to 10 or more carbon atoms that are saturated or unsaturated, and where R and R' can be the same or different.

Other compounds formed in the mixture of oxidized disulfide oil compounds can have the structure $O_x$RSSOH, where x is 2, 3, or 4 and R can be straight, branched or cyclic hydrocarbons having 1, 2, 3 and up to 10 or more carbon atoms that are saturated or unsaturated.

Table 3 includes ODSO compounds that are polar and water-soluble, and also those that are non-polar and water insoluble. ODSO compounds that contain 1 and 2 oxygen atoms are non-polar and water insoluble. ODSO compounds that contain 3 or more oxygen atoms are water-soluble. The production of either polar or non-polar ODSO compounds is in part dependent on the reaction conditions during the oxidation process. The structure of some of the compounds in Table 3 were derived by comparing experimental $^{13}$C-135-DEPT-NMR spectra of the oxidized DSO mixture with a saved database of predicted spectra for the closest correspondence.

TABLE 3

| ODSO Name | Formula | Structure Examples |
|---|---|---|
| Dialkyl-thiosulfoxide or alkyl-alkane-sulfinothioate | (R—SO—S—R) | 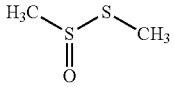 S-Methyl methanesulfinothioate |
| Dialkyl-thiosulfones or Alkyl-Alkane-thiosulfonate | (R—SOO—S—R) | 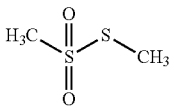 Methyl Methanethiosulfonate |
| Dialkyl-sulfone-sulfoxide Or 1,2-alkyl-alkyl-disulfane 1,1,2-trioxide | (R—SOO—SO—R) | 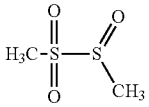 1,2-Dimethyldisulfane 1,1,2-trioxide |
| Dialkyl-disulfone Or 1,2-alkyl-alkyl-disulfane 1,1,2,2-tetraoxide | (R—SOO—SOO—R) | 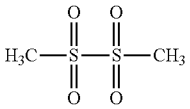 1,2-Dimethyldisulfane 1,1,2,2-tertraoxide |
| Dialkyl-disulfoxide | (R—SO—SO—R) | 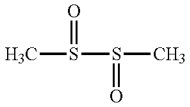 1,2-Dimethyldisulfane 1,2-dioxide |
| Alkyl-sulfoxide-sulfonate | (R—SO—SOO—OH) | 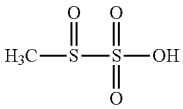 Methylsulfanesulfonic acid oxide |
| Alkyl-sulfone-sulfonate | (R—SOO—SOO—OH) | 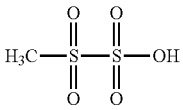 1-Hydroxy-2-methyldisulfane 1,1,2,2-tertraoxide |
| Alkyl-sulfoxide-sulfinate | (R—SO—SO—OH) | 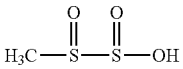 1-Hydroxy-2-methyldisulfane 1,2-dioxide |
| Alkyl-sulfone-sulfinate | (R—SOO—SO—OH) | 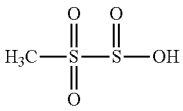 Methylsulfanesulfinic acid dioxide |

As will be understood by those skilled in the art, the temperature of the heavy crude at the wellhead can be in the range of from −45° C. to 120° C. or 150° C., or even up to 200° C. and will exhibit a much lower initial viscosity. The hot produced crude oil can be introduced into a pipeline for long distance transportation to a remote GOSP and/or refinery, or transferred at the elevated temperature into an accumulation tank. Depending upon the season and location of the wellhead and the GOSP, refinery or other holding or processing facility, the temperature of the crude oil will undergo a calculable reduction with a concomitant increase in viscosity that will result in an increase in the energy required to move the heavy oil through the transportation pipeline, and a corresponding reduction in the overall efficiency of the transportation.

In an embodiment of the present method and system, the DSO diluent stream is introduced into the pipeline in predetermined locations along the transport path and in predetermined amounts for the purpose of increasing the overall weight % of the DSO diluents in the heavy oil to periodically or intermittently reduce the viscosity of the heavy oil-diluent blend as it moves through the pipeline. As is well known from fluid mechanics, turbulence and associated loss of energy due to frictional forces occur at pipeline bends and junctions when the heavy oil undergoes a change in direction. The addition of DSO diluents to further reduce viscosity upstream of a section of pipeline in which the heavy oil will undergo significant changes in its flow path that create turbulence can serve to improve the efficiency of the transport through the zone of turbulent flow.

Additional savings can be achieved where the DSO diluent is recovered and recycled to a number of diluent addition stations that are located intermediate the wellhead or first addition station and the GOSP or refinery where the DSO diluent is separated and recovered from the heavy oil for return to one or more intermediate addition stations along the pipeline for use as recycled diluent.

Similarly, additional DSO diluent can be added to the moving heavy oil flowing in the pipeline as the temperature is reduced due to cooling under the prevailing ambient conditions, i.e., the conductive loss of heat through the pipeline walls. The addition of the DSO diluents at predetermined geographically separated locations along a generally straight pipeline that traverses distances extending hundreds of miles, or more, will serve to maintain the viscosity of the blended flow at, or within a desired viscosity range. Diluents can also advantageously be added to pipelines at intermediate locations between wellheads and oil field storage tanks, and between storage tanks and a GOSP or refinery during which transit the flowing heavy oil undergoes a significant reduction in temperature. Use of intermediate addition stations can provide savings in the volume of DSO diluent required to maintain the desired viscosity across the entire length of the pipeline. A savings will also be recognized because only a portion of the recycle diluent is transported to the initial injection point at the distant end of the pipeline.

As will be apparent to those of ordinary skill in the art, the use of one or more intermediate addition stations will require recycle diluent storage tanks, pumps, dedicated recycle transportation pipelines, means for mixing and/or injecting the diluent into the heavy crude, and associated control devices and utilities. Customary and conventional cost-to-benefit calculations can be applied to determine the number and location of intermediate addition stations.

In certain embodiments, not shown, the DSO diluent is simply mixed with the heavy oil stream to lower the viscosity of the heavy oil to facilitate pipeline transport for processing within the battery limits of the refinery.

Example 1

Figure 3:
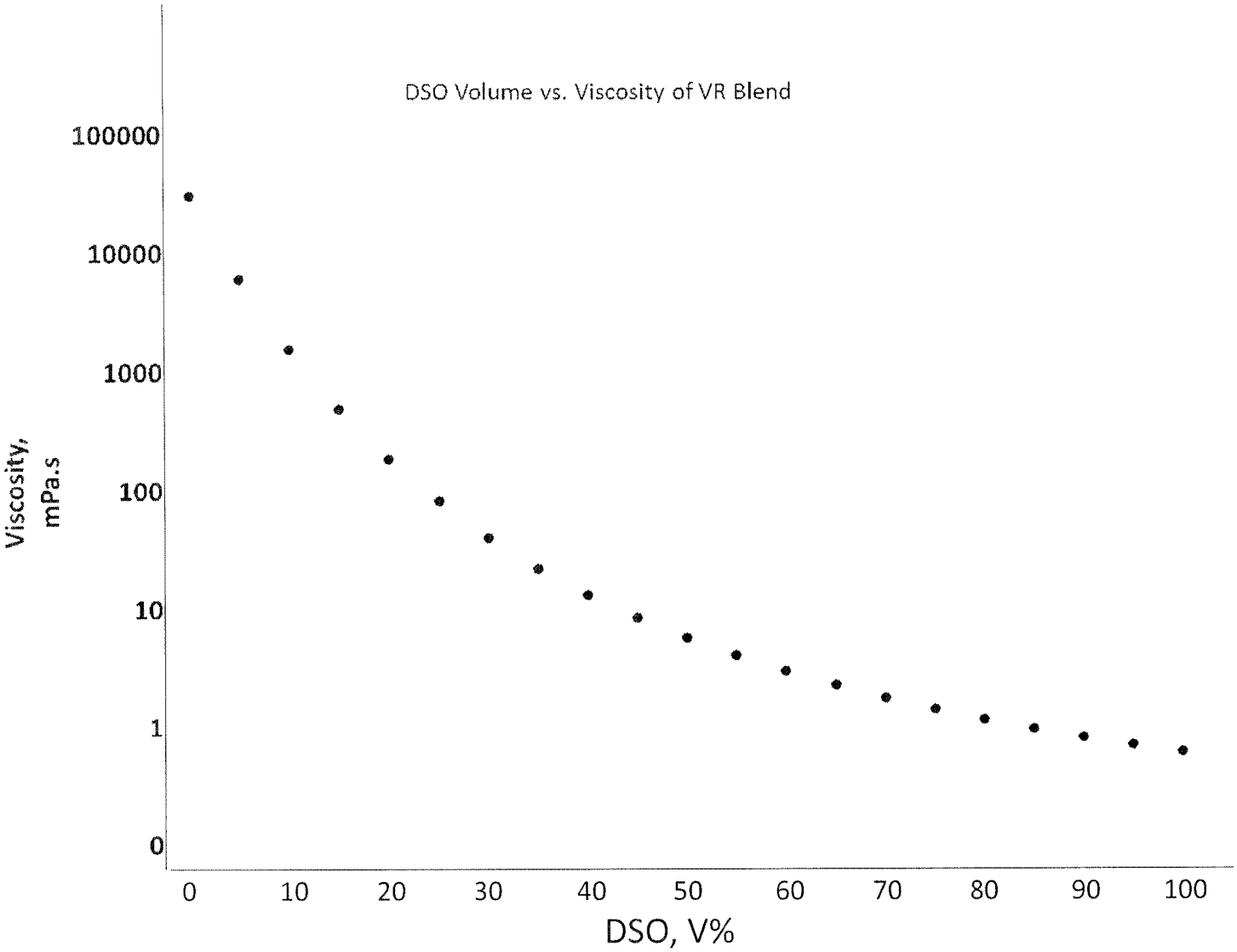
FIG. 3 is a graph illustrating the reduction in the viscosity of a heavy oil after addition and mixing with DSO recovered from a refinery mercaptan oxidation process.

The viscosities of samples of a vacuum residue and a DSO diluent recovered as a by-product of the mercaptan oxidation of a hydrocarbon refinery feedstock were measured at 37.7° C. and found to be 31,116 mPa·s and 0.61 mPa·s, respectively. The properties and composition of the DSO are provided in Table 2. A blending calculation for the vacuum residue-DSO diluent stream was carried out with the results shown in FIG. 3, with the simulated viscosity data for the heavy oil-diluent blend as a function of DSO diluent content in the blend. The results indicated that when the blend included 20V % of the DSO diluent, the viscosity of the blend is sufficiently lowered to meet the pipeline specification of <380 mPa·s, It will be understood from the above description that the process of the present disclosure provides a cost effective and environmentally acceptable basis for diverting by-product disulfide oils and their oxidized DSO derivatives to a beneficial use.

The process of the present invention has been described above and in the attached figures; process modifications and variations will be apparent to those of ordinary skill in the art from this description and the scope of protection is to be determined by the claims that follow.

The invention claimed is:

1. A process for reducing the viscosity of a heavy oil feedstream comprising mixing the heavy oil feedstream in at least one mixing zone with a predetermined amount of a liquid hydrocarbon diluent to produce a heavy oil-diluent blend that has a lower density and a lower viscosity than that of the heavy oil feedstream, wherein the liquid hydrocarbon diluent is one or more oxidized disulfide oil compounds having the general formula:

$O_xR'SSR$ where x is an integer in the range of from 1 to 4, R and R' are straight, branched or cyclic hydrocarbons having 1, 2, 3 and up to 10 or more carbon atoms that are saturated or unsaturated, and where R and R' can be the same or different.

2. The process of claim 1, wherein the heavy oil is selected from crude oil recovered at a wellhead, bitumens, heavy crude oil, coal liquids, atmospheric residue, vacuum residue, pitch from solvent deasphalting, and heavy oil derived from refinery processes such as distillation, solvent deasphalting, delayed coking, or FCC processing.

3. The process of claim 1, wherein the heavy oil-diluent blend comprises diluent in the range of from 1 to 99 W % of the total weight of the blend.

4. The process of claim 1, wherein the heavy oil-diluent blend comprises diluent in the range of from 5 to 50 W % of the total weight of the blend.

5. The process of claim 1, wherein the heavy oil has an initial viscosity of at least 1000 mPa·s at 50° C.

6. The process of claim 1, wherein the heavy oil has an API gravity of less than or equal to 30°.

7. A process for reducing the viscosity of a heavy oil feedstream for transportation in an oil pipeline, the process comprising:

a. mixing the heavy oil feedstream with a predetermined amount of a fresh liquid hydrocarbon diluent in a mixing zone at a first location to produce a heavy oil-diluent blend that has a lower density and a lower viscosity than the heavy oil feedstream alone, wherein the fresh diluent stream comprises one or more DSO compounds, one or more ODSO compounds, or their combination, where the DSO and ODSO compounds are derived from the mercaptan oxidation of a refinery feedstream;

b. recovering the heavy oil-diluent blend from the mixing zone as a product stream at the first location;

c. introducing the recovered heavy oil-diluent blend product stream into a first transportation pipeline for transportation to a second location.

8. The process of claim 7, further comprising the steps of:

d. receiving the heavy oil-diluent blend of step (c) in the second location and introducing the blend into a fractionation zone for separation of the heavy oil from the diluent;

e. recovering the liquid hydrocarbon diluent; and f. recovering or further processing the heavy oil as a product stream.

9. The process of claim 8, further comprising the steps of:

g. introducing the diluent recovered in step 14(e) into a second transportation pipeline and returning the diluent to the first location as a recycle diluent stream; and h. introducing the recycle diluent stream and fresh diluent for mixing with heavy oil to produce the heavy oil-diluent blend.

10. The process of claim 8, wherein the heavy oil feedstream is further processed in the second location fractionation zone to provide one or more feeds for downstream refinery operations.

11. The process of claim 7, wherein the heavy oil-diluent blend is free, or substantially free of sediment.

12. The process of claim 7, in which the heavy oil feedstream is wellhead crude oil.

13. The process of claim 7, wherein the heavy oil feedstream is selected from crude oil recovered at a wellhead, bitumens, heavy crude oil, coal liquids, atmospheric residue, vacuum residue, pitch from solvent deasphalting, and heavy oil derived from refinery processes such as distillation, solvent deasphalting, delayed coking, or FCC processing.

14. A process for reducing the viscosity of a heavy oil feedstream comprising mixing the heavy oil feedstream in at least one mixing zone with a predetermined amount of a liquid hydrocarbon diluent to produce a heavy oil-diluent blend that has a lower density and a lower viscosity than that of the heavy oil feedstream, wherein the liquid hydrocarbon diluent is one or more oxidized disulfide oil compounds having the general formula:

$O_xRSSOH$, where x is 2, 3, or 4 and R can be straight, branched or cyclic hydrocarbons having 1, 2, 3 and up to 10 or more carbon atoms that are saturated or unsaturated.

15. The process of claim 14, wherein the heavy oil feedstream is selected from crude oil recovered at a wellhead, bitumens, heavy crude oil, coal liquids, atmospheric residue, vacuum residue, pitch from solvent deasphalting, and heavy oil derived from refinery processes such as distillation, solvent deasphalting, delayed coking, or FCC processing.

16. A process for reducing the viscosity of a heavy oil feedstream comprising mixing the heavy oil feedstream in at least one mixing zone with a predetermined amount of a liquid hydrocarbon diluent selected from the group consisting of:

one or more DSO compounds, one or more ODSO compounds, or a combination thereof to produce a heavy oil-diluent blend that has a lower density and a lower viscosity than that of the heavy oil feedstream, wherein the heavy oil-diluent blend is passed from the at least one mixing zone to a transportation pipeline.

17. The process of claim 16, wherein the heavy oil-diluent blend has a viscosity of less than or equal to 380 mPa·s under the conditions in the transportation pipeline.

18. The process of claim 17, wherein the viscosity of the heavy oil-diluent blend is less than 200 mPa·s.

19. The process of claim 16, wherein the heavy oil-diluent blend passed to the transportation pipeline is at temperatures in the range of from 20° C. to 80° C. and at a pressure in the range of from 1 bar to 5 bars.

20. The process of claim 16, wherein the heavy oil feedstream is selected from crude oil recovered at a wellhead, bitumens, heavy crude oil, coal liquids, atmospheric residue, vacuum residue, pitch from solvent deasphalting, and heavy oil derived from refinery processes such as distillation, solvent deasphalting, delayed coking, or FCC processing.

* * * * *